US006689449B2

(12) United States Patent
Hasan et al.

(10) Patent No.: US 6,689,449 B2
(45) Date of Patent: Feb. 10, 2004

(54) ROOF DECKING MEMBRANE WELDING SYSTEM AND METHOD

(75) Inventors: S. Riaz Hasan, Palatine, IL (US); William J. Blucher, Addison, IL (US); Lawrence R. Reinebach, Glen Ellyn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 124 days.

(21) Appl. No.: 10/038,005

(22) Filed: Jan. 4, 2002

(65) Prior Publication Data

US 2003/0126816 A1 Jul. 10, 2003

(51) Int. Cl.[7] ..... E04B 5/00; B32B 3/04
(52) U.S. Cl. ..... 428/124; 52/409; 52/410
(58) Field of Search ..... 52/409, 410, 746.1, 52/511; 428/124, 99; 160/348

(56) References Cited

U.S. PATENT DOCUMENTS 3,137,972 A * 6/1964 Ekholm ..... 52/420
3,873,404 A * 3/1975 West ..... 428/124

(List continued on next page.)

FOREIGN PATENT DOCUMENTS

| | | | |
|---|---|---|---|
| CH | 395 485 | | 7/1965 |
| DE | 292 077 | | 1/1915 |
| FR | 2650-642 | * | 2/1991 |
| GB | 2027786 | | 2/1980 |

*Primary Examiner*—Carl D. Friedman
*Assistant Examiner*—Kevin McDermott
(74) *Attorney, Agent, or Firm*—Lisa M. Soltis; Mark W. Croll; Donald J. Breh

(57) ABSTRACT

A roof decking membrane welding system and method comprises first and second roof decking membranes having edge portions thereof welded to each other so as to define a seamed connection therebetween. The edge portion of a first one of the membranes is disposed beneath a seam plate and folded over the top of the seam plate so as to be secured upon itself either at a location adjacent to the seamed connection with the second membrane or between the first membrane and the edge portion of the second membrane. In either case, the folded edge portion of the first membrane forms a closed loop portion which presents multiple regions for load-sharing in resisting uplifting wind load forces. Alternatively, the edge portion of the first membrane is folded over itself but disposed beneath the seam plate so as to present dual plies of the first membrane for engagement with the seam plate so as to again provide load-sharing characteristics under uplifting wind load forces.

20 Claims, 3 Drawing Sheets

U.S. PATENT DOCUMENTS 4,137,352 A * 1/1979 Stonebridge ..... 428/102
4,278,719 A * 7/1981 Sarnecki ..... 428/78
4,493,175 A * 1/1985 Coppola, Jr. ..... 52/410
4,560,596 A * 12/1985 Coscia ..... 428/31
4,787,188 A 11/1988 Murphy
4,834,828 A 5/1989 Murphy
4,855,172 A * 8/1989 Chiu ..... 428/57
4,860,514 A * 8/1989 Kelly ..... 52/410
4,945,699 A 8/1990 Murphy
5,023,395 A * 6/1991 O'Connor ..... 174/36
5,035,028 A * 7/1991 Lemke ..... 24/336
5,065,553 A * 11/1991 Magid ..... 52/58
5,094,041 A * 3/1992 Kasner et al. ..... 52/57
5,161,342 A * 11/1992 Hasan et al. ..... 52/410
5,165,210 A * 11/1992 Partyka et al. ..... 52/746.11
5,168,684 A * 12/1992 Bruhm ..... 52/410
5,171,116 A * 12/1992 Gerhardt et al. ..... 411/368
5,204,148 A * 4/1993 Alexander et al. ..... 428/41.8
5,309,685 A 5/1994 Rathgeber et al.
5,311,716 A * 5/1994 Houssin ..... 52/410
5,319,908 A * 6/1994 Van Erden et al. ..... 52/410
5,469,671 A 11/1995 Rathgeber et al.
5,562,380 A * 10/1996 Hempfling et al. ..... 411/542
5,711,116 A 1/1998 Hasan
5,797,232 A * 8/1998 Larson ..... 52/408
5,800,891 A * 9/1998 Wasitis ..... 428/42.2
5,803,693 A * 9/1998 Choiniere et al. ..... 411/537
6,004,645 A 12/1999 Hubbard
6,055,786 A 5/2000 Hubbard et al.
6,187,122 B1 2/2001 Hubbard et al.
6,250,034 B1 6/2001 Hulsey
6,427,412 B1 * 8/2002 Mayle et al. ..... 52/545
6,442,904 B1 * 9/2002 Ortiz ..... 52/11

* cited by examiner

FIG. 2
(PRIOR ART)
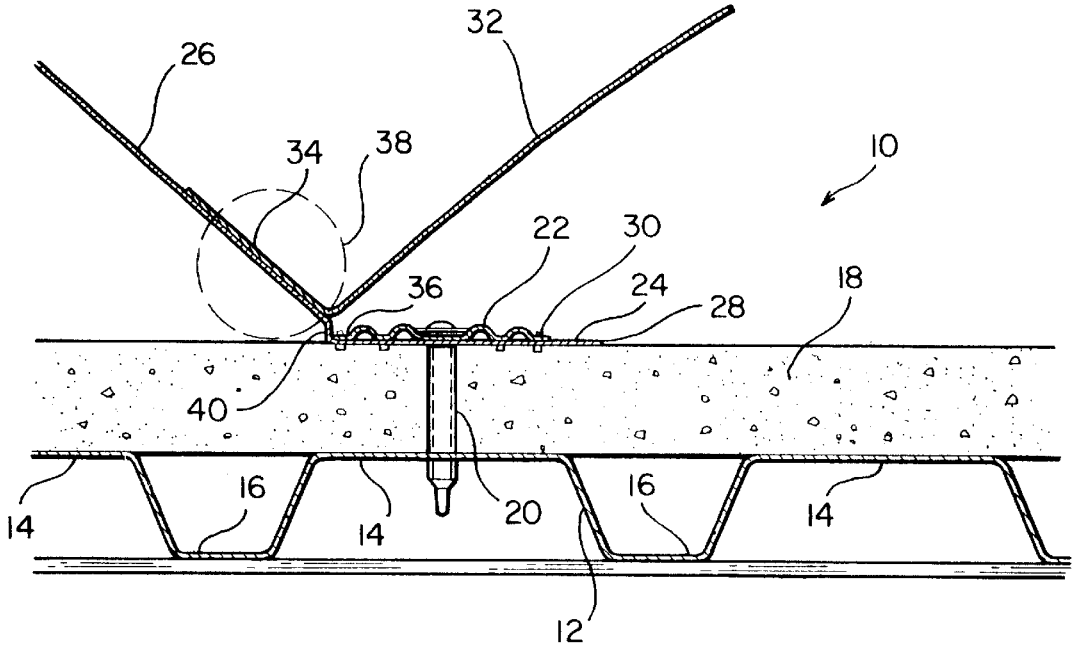
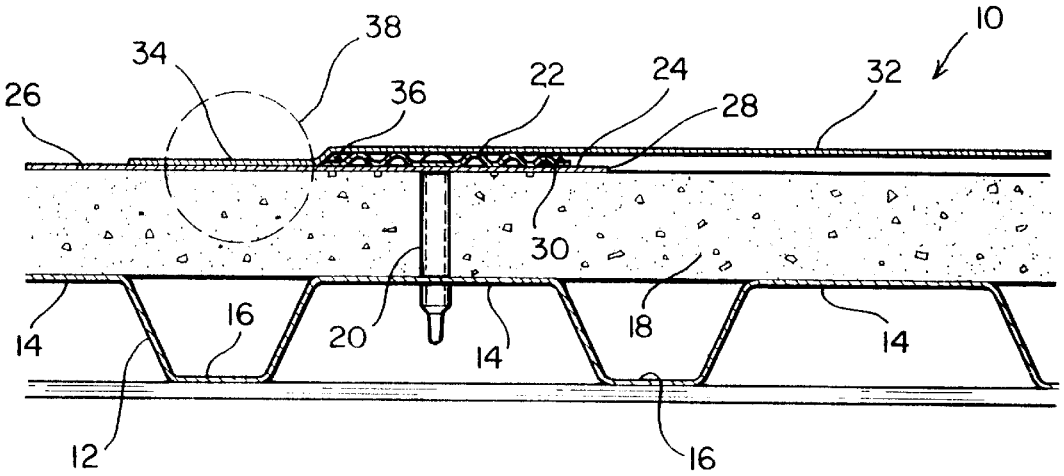
FIG. 1
(PRIOR ART)

ROOF DECKING MEMBRANE WELDING SYSTEM AND METHOD

FIELD OF THE INVENTION

The present invention relates generally to roof decking membrane welding and attachment systems, and more particularly to a new and improved roof decking membrane welding and attachment system, and a method of implementing the same, wherein improved or enhanced strength and failure-resistance attributes or properties, characteristic of the roof decking membrane, are able to be achieved.

BACKGROUND OF THE INVENTION

In the building industry, roof decking components or structural members conventionally have insulation slabs or substrates disposed thereon, and weather-protection membranes are in turn adapted to be secured atop the insulation slabs or substrates so as to protect the same from deterioration which would otherwise occur as a result of being exposed to various environmental or weather conditions. The membranes and the underlying insulation slabs or substrates are conventionally secured to the underlying roof decking by means of fastener assemblies which may comprise, for example, a combination of roofing, seam, or membrane plates, batten strips, or batten bars, which are adapted to be disposed atop the membranes, whereupon, in turn, suitable bolt fasteners secure the plates, batten strips, or batten bars to the underlying roof decking. Examples of such membrane, plate, and batten strip or batten bar mounting systems are disclosed within U.S. Pat. No. 6,250,034 which issued on Jun. 26, 2001 to Hulsey, U.S. Pat. No. 6,187,122 which issued on Feb. 13, 2001 to Hubbard et al., U.S. Pat. No. 6,055,786 which issued on May 2, 2000 to Hubbard et al., U.S. Pat. No. 5,711,116 which issued on Jan. 27, 1998 to Hasan, U.S. Pat. No. 5,469,671 which issued on Nov. 28, 1995 to Rathgeber et al., U.S. Pat. No. 5,309,685 which issued on May 10, 1994 to Rathgeber et al., U.S. Pat. No. 4,945,699 which issued on Aug. 7, 1990 to Murphy, U.S. Pat. No. 4,834,828 which issued on May 30, 1989 to Murphy, and U.S. Pat. No. 4,787,188 which issued on Nov. 29, 1988 to Murphy.

With reference initially being made to FIGS. 1 and 2, a conventional PRIOR ART roof decking membrane welding or attachment system or technique is disclosed and is generally indicated by the reference character 10. Roof decking is disclosed at 12, and it is seen that the roof decking 12 has a corrugated configuration comprising a plurality of transversely spaced crest portions 14 and a plurality of transversely spaced root portions 16 interposed between the crest portions 14. An insulation slab or panel 18 is disposed atop the roof decking 12 and is adapted to be secured to the roof decking 12 by means of a plurality of, for example, transversely spaced bolt fasteners 20, only one of which is shown, which are adapted to be threadedly engaged within predetermined ones of the transversely spaced crest portions 14 of the roof decking 12. Environmental-protection or weather-resistant membranes are also adapted to be disposed and secured atop the insulation slab or panel 18, and in accordance with conventional techniques, a seam plate or membrane plate 22, similar, for example, to that disclosed within the aforenoted Hulsey patent, is adapted to be secured upon the upper surface portion of the insulation slab or panel 18 by means of one of the bolt fasteners 20. A right lateral side edge portion 24, as viewed in the drawing figures, of a first membrane member or component 26 is disposed beneath the seam plate or membrane plate 22 so as to therefore effectively be trapped beneath the seam or membrane plate 22 with the free edge region 28 of the first membrane member or component 26 extending outwardly beyond a first right side portion 30 of the seam or membrane plate 22.

A second membrane member or component 32 is adapted to be fixedly secured to or mated with the first membrane member or component 26 so as to effectively provide continuity with the first membrane member or component 26, thereby, in turn, providing continuous weather or environmental protection for the underlying insulation panel 18 across the entire lateral extent thereof. Accordingly, the second membrane member or component 32 is disposed over the seam or membrane plate 22 and the bolt fastener 20 such that a left lateral side edge portion 34, as viewed in the drawing figures, of the second membrane member or component 32 is able to be fixedly attached to the underlying first membrane member or component 26 within a region of the first membrane member or component 26 which is disposed upon a second side portion 36 of the seam or membrane plate 22 disposed diametrically opposite the first side portion 30. The first and second membrane members or components 26,32 are adapted to be, for example, welded together by means of suitable conventional heat or other techniques, and the extent of the welded overlapped membrane region is schematically illustrated as being within the dotted lined circle 38. Alternatively, in lieu of the overlapped regions of the first and second membranes being welded together, the overlapped regions of the first and second membranes may be adhesively bonded together. In either case, it is critically important that the first and second membranes that are fixedly connected together be capable of withstanding, for example, wind lift or load forces so as to remain intact and therefore in fact be capable of continuously protecting the underlying insulation slab or panel under various environmental or weather conditions.

As can readily be appreciated from a comparison of FIGS. 1 and 2, FIG. 1 illustrates the roof decking system or assembly 10 in the absence of wind load or lift conditions, while FIG. 2 illustrates the roof decking system or assembly 10 under wind load or lift conditions. Accordingly, it can be appreciated still further that under wind load conditions, negative pressure conditions disposed above the roof decking membrane members 26,32 causes the membranes 26,32 to effectively be sucked upwardly as schematically illustrated within FIG. 2. It is specifically noted that as a result of such wind loads and the suction forces effectively impressed upon the membranes 26,32, and as a result of the particular mode or manner by means of which the first and second membranes 26,32 are welded together, when such wind loads and suction forces act upon the membranes 26,32, only the single ply first membrane 26 is disposed in contact with the left edge, left end, or left side portion 36 of the seam or membrane plate 22, as noted at 40, and is forcefully moved toward a vertically upward 90° orientation with respect to, for example, the right lateral side edge portion 24 of the membrane 26 which is simply disposed beneath the seam plate or membrane plate 22 and does not play any interactive role in connection with resisting or counteracting such uplifting wind loads or forces. Accordingly, such forces or loads acting upon the membrane 26, and the vulnerable attachment point of the membrane 26 with respect to the membrane plate 22, often leads to failure of the membrane 26 in the form of tearing of the membrane 26 around, for example, the left side edge portion 36 of the seam or membrane plate 22 which, in turn, eventually leads to the membrane 26 becoming separated from that portion of the membrane 26 which remains entrapped beneath the seam or membrane plate 22.

In addition to the aforenoted forces or loads acting upon the membrane 26 and its vulnerable attachment point portion 40 with respect to the seam or membrane plate 22, such wind loads or forces acting upon both membranes 26,32, through means of the welded region 38, and in particular as concentrated at the attachment point portion or region 40, will also tend to impress uplifting forces upon the seam or membrane plate 22. These forces or loads, in turn, cause forces or loads to be impressed, by means of the membrane plate 22, upon the bolt fastener 20 thereby tending to, over a period of time, cause loosening of the bolt fastener 20 within the underlying roof decking 12, thereby again, leading to the effective failure of the membranes 26,32 protecting the underlying insulation slab or panel 18. These effects or results are exacerbated even further in view of the current tendency for roof decking systems to be utilizing larger-sized roof decking membranes. For example, the weather protection membranes 26,32 have conventionally comprised membranes having a width dimension of approximately six feet (6.00'), however, within recent times, and in accordance with new industry standards or norms, membranes having width dimensions on the order of, for example, nine feet (9.00'), seem to be utilized more often. Consequently, such newer membranes comprise or cover square footage areas which are substantially fifty percent (50%) greater than those of the conventional or previously utilized membranes, and accordingly, such larger membranes represent or generate enhanced wind loads or forces acting upon the membranes, the seam or membrane plates, and the bolt fasteners securing the membranes and the seam plates to the underlying insulation panels.

Therefore, membrane and bolt fastener assembly failures are likely to increase, unless the aforenoted problems are adequately addressed. A proposed solution to the problem has been to simply increase the number of attachment sites at which the seam plates and bolt fasteners can be secured to the underlying insulation panels and roof decking, however, this is not a viable solution for several reasons. For example, the number of attachment sites, or more particularly, the array or arrangement of the attachment sites, is predetermined, or in effect dictated, by means of the underlying roof decking in view of the fact that the bolt fasteners must be threadedly engaged within the crest portions of the roof decking. Conventionally, the predetermined distance defined between adjacent corrugations of the roof decking, as measured, for example, from crest to crest, is six inches (6.00"), and in accordance with conventional techniques for affixing the membranes to the underlying roof decking, the seam plate and bolt fastener assemblies are secured to alternative crest portions of the roof decking such that the predetermined distance defined between adjacent seam plate and bolt fastener assemblies is twelve inches (12.00"). Therefore, if additional attachment sites, at which additional seam plate and bolt fastener assemblies would be installed, were to be employed, the additional seam plate and bolt fastener assemblies would be installed within those crest portions of the roof decking which do not currently have seam plate and bolt fastener assemblies installed therein, thereby effectively doubling the number of seam plate and bolt fastener assemblies used to secure the membranes to the underlying roof decking. However, the effective doubling of the seam plate and bolt fastener assemblies renders the attachment system prohibitively expensive in terms of both hardware costs as well as man-hour installation costs.

A need therefore exists in the art for a new and improved roof decking membrane welding attachment system, and a method of implementing the same, wherein stronger wind force or wind load resistance values will effectively be developed or inherently provided within the membrane member or component underlying the seam or membrane plate such that the membrane member or component underlying the seam or membrane plate will not readily experience or undergo failure, when the insulation-protection, welded membranes are subjected to negative or suction wind forces or wind loads, so as to effectively prevent the separation of the membrane member or component from its disposition beneath the seam or membrane plate and thereby maintain the structural integrity of the membrane system so as to retain its weather and environmental protection for the underlying insulation panel.

OBJECTS OF THE INVENTION

Accordingly, it is an object of the present invention to provide a new and improved roof decking membrane attachment system, and a method of implementing the same.

Another object of the present invention is to provide a new and improved roof decking membrane attachment system, and a method of implementing the same, so as to effectively overcome the various operational and structural drawbacks and disadvantages characteristic of conventional PRIOR ART roof decking membrane systems.

An additional object of the present invention is to provide a new and improved roof decking membrane attachment system, and a method of implementing the same, wherein as a result of the particularly unique manner in which the membrane members are welded or attached with respect to the various structural components of the overall membrane system or assembly, stronger wind force or wind load resistance values will effectively be developed or inherently provided within the membrane member or component underlying the seam or membrane plate.

A further object of the present invention is to provide a new and improved roof decking membrane attach-ment system, and a method of implementing the same, wherein as a result of the particularly unique manner in which the membrane members are welded or attached with respect to the various structural components of the overall membrane system or assembly, stronger wind force or wind load resistance values will effectively be developed or inherently provided within the membrane member or component underlying the seam or membrane plate such that the membrane member or component underlying the seam or membrane plate will not readily experience or undergo failure when the insulation-protection, welded membranes are subjected to negative or suction wind forces or wind loads.

A last object of the present invention is to provide a new and improved roof decking membrane attach-ment system, and a method of implementing the same, wherein as a result of the particularly unique manner in which the membrane members are welded or attached with respect to the various structural components of the overall membrane system or assembly, stronger wind force or wind load resistance values will effectively be developed or inherently provided within the membrane member or component underlying the seam or membrane plate such that the membrane member or component underlying the seam or membrane plate will not readily experience or undergo failure when the insulation-protection, welded membranes are subjected to negative or suction wind forces or wind loads so as to effectively prevent the separation of the membrane member or component from its disposition beneath the seam or membrane plate and thereby maintain the structural integrity of the membrane system so as to retain its weather and environmental protection for the underlying insulation panel.

SUMMARY OF THE INVENTION

The foregoing and other objectives are achieved in accordance with the teachings and principles of the present invention through the provision of a new and improved roof decking membrane attachment system, and a method of implementing the same, wherein the membrane member or component underlying the membrane or seam plate is folded over upon itself in accordance with a single-fold, dual-ply, single-weld attachment technique. In accordance with a first embodiment of the invention, the membrane underlying the seam plate is folded over the seam plate and bolt fastener and re-attached to itself along with the second membrane, while in accordance with a second embodiment of the invention, the membrane underlying the seam plate is folded over upon itself so as to be disposed beneath the seam plate. In either case, stronger wind force or wind load resistance values are effectively able to be developed or inherently provided within the membrane member underlying the seam plate such that the membrane member underlying the seam plate will not readily experience or undergo failure when the insulation-protection, welded membranes are subjected to negative or suction wind forces or wind loads. In turn, the attachment technique and lack of failure within the membrane effectively prevents the separation of the membrane member from its disposition beneath the seam plate and thereby enables the membrane system to maintain its structural integrity and thereby retain its weather and environmental protection for the underlying insulation panel.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 1 is cross-sectional elevational view of a conventional PRIOR ART roof decking membrane system showing the attachment and disposition of roof decking membranes with respect to each other and to the underlying insulation panel and roof decking, by means of a seam plate and a bolt fastener sub-assembly, in the absence of uplifting wind load forces;

FIG. 2 is cross-sectional elevational view of the conventional PRIOR ART roof decking membrane system as shown in FIG. 1 showing the attachment and disposition of the roof decking membranes under wind load force conditions;

DETAILED DESCRIPTION OF THE ILLUSTRATED EMBODIMENTS

Figure 3:
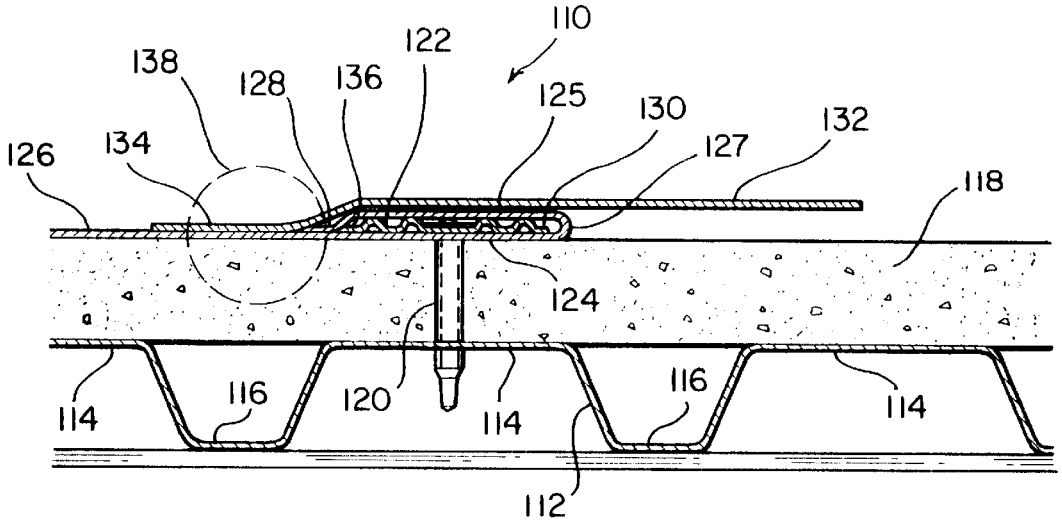
FIG. 3 is a cross-sectional elevational view, similar to that of FIG. 1 showing, however, a first embodiment of a new and improved roof decking membrane system, in the absence of uplifting wind load forces, constructed in accordance with the principles and teachings of the present invention whereby the attachment and disposition of the roof decking membranes with respect to each other and to the underlying insulation panel and roof decking, by means of a seam plate and a bolt fastener sub-assembly, is able to achieve improved strength, wind-force resistance, and tear-resistance properties.

Referring now to the drawings, and more particularly to FIG. 3 thereof, a first embodiment of a new and improved roof decking membrane attachment system, constructed in accordance with the principles and teachings of the present invention, is disclosed and is generally indicated by the reference character 110. It is to be noted that those structural components of the new and improved roof decking membrane attachment system 110 that correspond to those structural components of the roof decking membrane attachment system 10 will be designated by similar reference characters except that the reference characters will be within the 100 series. Accordingly, it is seen that the new and improved roof decking membrane attachment system 110 comprises roof decking 112, and it is seen that the roof decking 112 has a corrugated configuration comprising a plurality of transversely spaced crest portions 114 and a plurality of transversely spaced root portions 116 interposed between the crest portions 114. An insulation slab or panel 118 is disposed atop the roof decking 112 and is adapted to be secured to the roof decking 112 by means of a plurality of, for example, transversely spaced bolt fasteners 120, only one of which is shown, which are adapted to be threadedly engaged within predetermined ones of the transversely spaced crest portions 114 of the roof decking 112. Environmental-protection or weather-resistant membranes are also adapted to be disposed and secured atop the insulation slab or panel 118, and in accordance with conventional techniques, a hold-down element comprising a seam plate or membrane plate 122, similar, for example, to that disclosed within FIGS. 1 and 2, is adapted to be secured upon the upper surface portion of the insulation slab or panel 118 by means of one of the bolt fasteners 120. It is to be noted that, for the purposes of this invention, any type of seam or membrane plate may be utilized, and still further, in lieu of a seam or membrane plate, known batten bars or batten strips may likewise be employed as the hold-down elements.

A right end region or section 124 of a first membrane member or component 126 is adapted to be disposed beneath the seam plate or membrane plate 122 in a conventional manner so as to therefore be effectively trapped beneath the seam or membrane plate 122, however, contrary to conventional attachment techniques, and in accordance with the specific principles and teachings of the present invention, an extended right side region or section 125 of the first membrane member or component 126 is adapted to be folded with respect to itself and over the right side portion 130 of the seam or membrane plate 122 so as to be disposed over or atop the seam or membrane plate 122. Still further, the free edge region or section 128 of the first membrane member or component 126 is then adapted to be secured, for example, by means of suitable heat-welding techniques, to the main or primary portion or section of the first membrane member or component 126 at a welded position 128 substantially adjacent to the left side edge portion 136 of the seam or membrane plate 122, whereby the portions or sections 124,125 respectively disposed beneath and atop the seam or membrane plate 122 effectively form a closed loop portion 127 of the first membrane member or component 126 with the seam or membrane plate 122 enveloped therewithin.

In order to complete the seamed continuity of the membrane structure for environmentally protecting the underlying insulation panel or slab 118, as defined between adjacent membrane members or components, it is further appreciated that a second membrane member or component 132 is disposed atop the extended section 125 of the first membrane 126 whereby a left edge region or section 134 can be welded to the upper surface portion of the first membrane member or component 126 at a position immediately adjacent to the welded edge section 128 of the first membrane member or component 126. In this manner, the edge or end portions 128,134 of the first and second membrane members or components 126, 132 are both able to be welded to the upper surface portion of the first membrane member or component 126 so as to effectively define a single weld region as illustrated by means of the dotted circular locus 138.

As a result of the structural arrangement of the various components of the roof decking membrane assembly or system 110, and the particular manner in which the edge regions or portions of the first and second membranes 126,132 are attached or welded together within the single welded region 138, it can be appreciated that when the first and second membranes 126,132 are subjected to uplifting wind load forces, enhanced strength, wind-force resistance, and tear-resistance properties will be exhibited by means of the roof decking membrane assembly or attachment system 110. More particularly, in view of the formation of the looped portion 127 of the first membrane 126, and the welded attachment of the second membrane 132 to the first membrane 126 by means of the left edge region 134 and within the single weld zone 138, then when the first and second membranes 126,132 are subjected to uplifting wind load forces, opposite end portions of the first membrane member or component 126, disposed within the vicinities of the end portions 130,136 of the seam plate 122, are effectively utilized to counteract and withstand such uplifting wind load forces. Considered from a different viewpoint or perspective, the opposite end portions of the first membrane member or component 126 effectively work together so as to combine their resistive properties and exhibit load-sharing reactive forces to the uplifting wind load forces. As a result, the tear-resistance forces of the membrane 126 are enhanced thereby leading to significantly reduced membrane failures.

Figure 4:
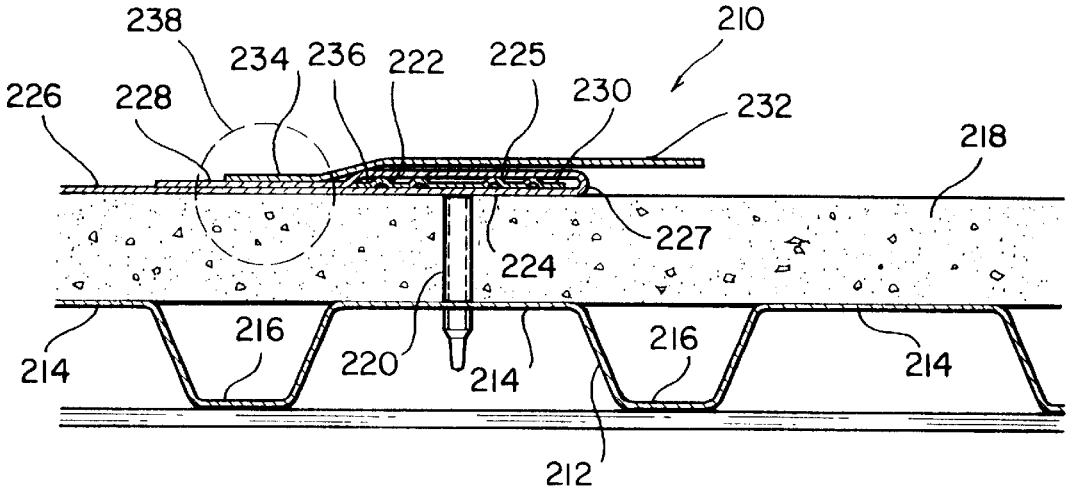
FIG. 4 is a cross-sectional elevational view similar to that of FIG. 3 showing, however, a second modified embodiment of the first embodiment of the new and improved roof decking membrane system, in the absence of uplifting wind load forces, constructed in accordance with the principles and teachings of the present invention so as to likewise achieve improved strength, wind-force resistance, and tear-resistance properties.

With reference now being made to FIG. 4 of the drawings, a second embodiment of a new and improved roof decking membrane attachment system, constructed in accordance with the principles and teachings of the present invention, is disclosed and is generally indicated by the reference character 210. It is to be noted that those structural components of the new and improved roof decking membrane attachment system 210 that correspond to those structural components of the first embodiment of the roof decking membrane attachment system 110 of the present invention will be designated by similar reference characters except that the reference characters will be within the 200 series. It is additionally noted that since the roof decking membrane attachment system 210 is substantially the same as the roof decking membrane attachment system 110, except as will be noted hereinafter, a detailed description of the roof decking membrane attachment system 210 will be omitted, and the discussion of the same will be limited or restricted to that portion of the system 210 which differs from the system 110. More particularly, the only significant structural difference between the roof decking membrane attachment system 210 and the roof decking membrane attachment system 110 resides in the fact that in accordance with the attachment system 210, it is seen that, in lieu of the free edge portion 128 of the first membrane 126 being welded to the upper surface portion of the first membrane 126 at a position immediately adjacent to the position at which the edge portion 134 of the second membrane 132 is welded to the upper surface portion of the first membrane 126, a bottom surface portion of the free edge portion 228 of the first membrane 226 is welded to the upper surface portion of the first membrane 226 and the edge portion 234 of the second membrane 232 is welded to the upper surface portion of the free edge portion 228 of the first membrane 226. The welded attachment of the edge portion 234 of the second membrane 232 to the edge portion 228 of the first membrane 226, and the welded attachment of the free edge portion 228 of the first membrane 226 to the upper surface portion of the first membrane 226 together define a single weld region as illustrated by means of the dotted circular locus 238. As was the case with the first embodiment system 110 of the present invention, the opposite end portions of the first membrane member or component 226, disposed within the vicinities of the end portions 230,236 of the seam plate 222, effectively work together so as to combine their resistive properties and exhibit load-sharing reactive forces to the uplifting wind load forces. As a result, the tear-resistance forces of the membrane 126 are enhanced thereby leading to significantly reduced membrane failures.

Figure 5:
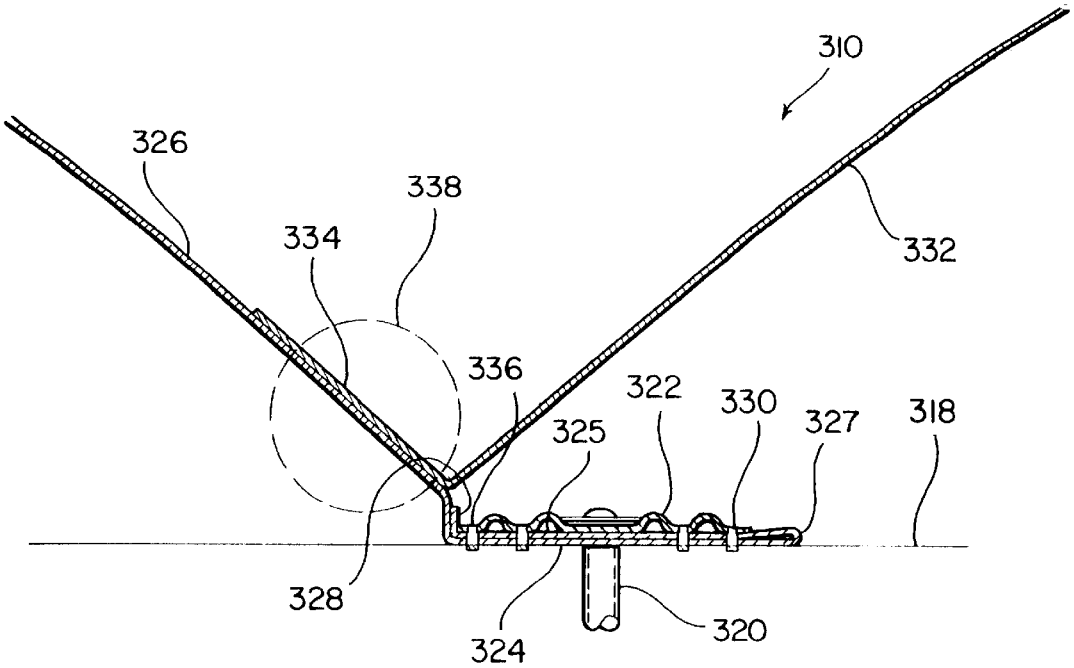
FIG. 5 is a cross-sectional elevational view similar to that of FIGS. 3 and 4 showing, however, a third embodiment of a new and improved roof decking membrane system, as secured to an upper surface portion of an insulation panel, which is constructed in accordance with the teachings and principles of the present invention so as to achieve in, the presence of uplifting wind load forces, improved strength, wind-force resistance, and tear-resistance properties.

With reference now being made to FIG. 5, a third embodiment of a new and improved roof decking membrane attachment system, constructed in accordance with the principles and teachings of the present invention, is disclosed and is generally indicated by the reference character 310. It is to be noted that those structural components of the new and improved roof decking membrane attachment system 310 that correspond to those structural components of the first and second embodiments of the roof decking membrane attachment systems 110 and 210 of the present invention will be designated by similar reference characters except that the reference characters will be within the 300 series. In addition, it is noted that since the roof decking membrane attachment system 310 is somewhat similar to the roof decking membrane attachment systems 110 and 210, except as will be noted hereinafter, a detailed description of the roof decking membrane attachment system 310 will be omitted, and the discussion of the same will be limited or restricted to that portion of the system 310 which differs from the systems 110 and 210. More particularly, in accordance with the specific teachings of this third embodiment of the present invention, the right end region or section 324 of the first membrane member or component 326 is disposed beneath the seam plate 322, and the extended portion 325 of the first membrane member 326 is folded over upon itself, as at 327 and as was the case with the first and second attachment systems 110,210, however, in lieu of the extended portion 325 of the first membrane member 326 being disposed over the seam plate 322, the extended portion 325 of the first membrane member 326 is also inserted, and effectively trapped, beneath the seam plate 322.

Figure 6:
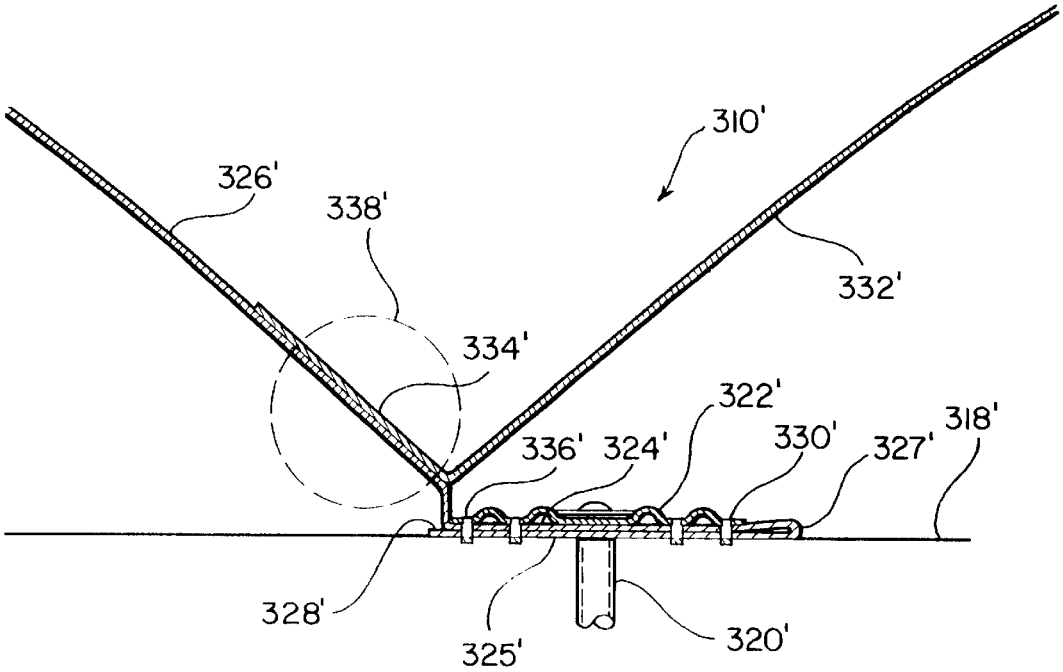
FIG. 6 is a cross-sectional elevational view similar to that of FIG. 5 showing, in effect, an improper structural arrangement of the components comprising the third embodiment of the new and improved roof decking membrane system, in the presence of uplifting wind load forces, whereby the improved strength, wind-force resistance, and tear-resistance properties would not in fact be able to be achieved.

More specifically, it is seen that the extended portion 325 of the first membrane member 326 is folded with respect to itself as at 327 in such a manner that the extended portion 325 of the first membrane member or component 326 is desirably disposed atop the right end region or portion 324 of the first membrane member or component 326 as opposed to being undesirably disposed beneath the right end region or portion 324' of the first membrane member or component 326' as disclosed within FIG. 6. In this manner, the right end portion 324 of the first membrane member or component 326 extends completely beneath the seam plate 322, the free edge portion 328 of the first membrane member 326 projects outwardly beyond the left side edge portion 336 of the seam plate 322, and the extended portion 325 of the first membrane member or component 326 is thus effectively trapped between the primary portion of the first membrane member or component 326 and the seam plate 322. This disposition of the extended portion 325 of the first membrane member or component 326 atop the right end region or portion 324 of the first membrane member or component 326, and the overall arrangement of the different components with respect to each other, is critically important as can be readily appreciated from a comparison between FIGS. 5 and 6.

More particularly, as can readily be appreciated from FIG. 5, when the extended portion 325 of the first membrane member or component 326 is folded atop the right end region or portion 324 of the first membrane member or component 326 so as to be effectively trapped between the primary portion of the first membrane member or component 326 and the seam plate 322, then the free edge portion 328 of the first membrane member 326 will effectively cooperate with the primary region or section of the first membrane member 326, disposed immediately within the vicinity of the left side edge portion 336 of the seam plate 322, so as to engage the left side edge portion 336 of the seam plate 322 as a dual-ply membrane assembly. In this manner, when the uplifting wind load forces act upon the first and second membrane members 326,332, the dual-ply membrane assembly, comprising the primary region or section of the first membrane member 326 and the free edge portion 328 of the first membrane member 326, will be forced upwardly to a position substantially 90° with respect to the horizontal disposition of the seam plate 322 so as to engage the left side edge portion of the seam plate 322. Accordingly, the disposition of a dual-ply membrane assembly into engagement with the left side edge portion of the seam plate 322 serves to provide load-sharing properties between the plies of the dual-ply membrane assembly and thereby renders the dual-ply membrane assembly substantially stronger than a single-ply membrane whereby, in turn, tear-resistance of the first membrane member 326 with respect to the seam plate 322 is likewise substantially enhanced.

To the contrary, however, with the attachment system, technique, or method 310' as disclosed within FIG. 6, the extended portion 325' of the first membrane member 326' is folded, as at 327', beneath the right end region or section 324' of the first membrane member 326' and therefore, when the uplifting wind load forces act upon the first and second membrane members 326',332', only a single ply of the first membrane member 326' is uplifted to a 90° orientation mode with respect to seam plate 322' so as to only be able to solely or singly engage the left side edge portion 336' of the seam plate 322'. Accordingly, it can be seen that the strength characteristics, and tear-resistance properties of the attachment system, technique, or method 310' which is disclosed within FIG. 6 are not as great as those of the attachment system, technique, or method 310 which is disclosed within FIG. 5.

Thus, it may be seen that in accordance with the principles and teachings of the present invention, there has been disclosed a new and improved roof decking membrane attachment system, method, or technique by means of which strength, wind-resistance, and tear-resistant properties of the insulation-protection membranes are significantly enhanced. In particular, in accordance with the present invention, as a result of a single folding over of an end portion of the first membrane member or component, a dual-ply region of the first membrane member is effectively created which permits load-sharing to be developed or created between two sections of the first membrane member so as to effectively enhance the strength of the first membrane member, and the consequent wind-resistance and tear-resistance properties of the first membrane member, particularly within the vicinity of the seam or membrane plate, in connection with uplifting wind load forces impressed upon the first and second membrane members welded together.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United State of America, is:

1. A roof decking membrane welding system, comprising:

a roof decking substructure assembly;

a first roof decking membrane disposed atop said roof decking substructure for protecting said roof decking substructure from environmental conditions;

a second roof decking membrane disposed atop said roof decking substructure for protecting said roof decking substructure from environmental conditions, said first and second roof decking membranes having first and second portions, respectively, which are adapted to be mated together so as to form a seamed connection whereby said first and second roof decking membranes together provide continuous protection for said roof decking substructure against environmental conditions;

a hold-down structure for engaging a portion of said first roof decking membrane for securing said first roof decking membrane to said roof decking substructure; and a fastener engaged with said hold-down structure and fixedly secured within said roof decking substructure so as to secure said hold-down structure upon said roof decking substructure;

said first roof decking membrane comprising a section which is folded and secured with respect to itself such that when uplifting wind load forces act upon said first and second roof decking membranes, through means of said seamed connection, at least two sections of said first membrane will together operatively engage said hold-down structure and exhibit load-sharing reactive forces for resisting said up-lifting wind load forces.

2. The system as set forth in claim 1, wherein:

said hold-down structure comprises an element selected from the group comprising membrane plates, membrane battens, membrane bars, and membrane strips.

3. The system as set forth in claim 1, wherein:

said folded section of said first roof decking membrane comprises an edge section which is folded over said fastener and said hold-down structure and secured to said first roof decking membrane at a location immediately adjacent to said seamed connection, defined between said first and second portions of said first and second roof decking membranes, so as to define a closed loop which envelops said fastener and said hold-down structure.

4. The system as set forth in claim 3, wherein:

said location at which said folded edge section of said first roof decking membrane which is secured to said first roof decking membrane, and said seamed connection defined between said first and second portions of said first and second roof decking membranes, comprises a single welded region.

5. The system as set forth in claim 1, wherein:

said folded section of said first membrane comprises an edge section which is folded over said fastener and said hold-down structure and secured by a first surface portion thereof to said first roof decking membrane so as to define a closed loop which envelops said fastener and said hold-down structure; and said second portion of said second roof decking membrane is secured to a second surface portion of said edge section of said first roof decking membrane which defines said first portion of said first roof decking membrane defining said seamed connection.

6. The system as set forth in claim 5, wherein:

said folded edge section of said first roof decking membrane which is secured to said first roof decking membrane, and said seamed connection defined between said first and second portions of said first and second roof decking membranes, comprises a single welded region.

7. The system as set forth in claim 1, wherein:

said folded section of said first roof decking membrane comprises an edge section which is folded beneath said hold-down structure so as to have two plies of said first roof decking membrane secured beneath said hold-down structure at a location immediately adjacent to said seamed connection defined between said first and second portions of said first and second roof decking membranes.

8. The system as set forth in claim 1, wherein:

said folded section of said first roof decking membrane comprises an edge section which is folded over itself so as to be disposed atop said first roof decking membrane and beneath said hold-down structure so as to have two plies of said first roof decking membrane secured beneath said hold-down structure at a location immediately adjacent to said seamed connection defined between said first and second portions of said first and second roof decking membranes.

9. A method of securing roof decking membranes to an underlying roof decking substructure, comprising the steps of:

providing a roof decking substructure assembly;

positioning a first roof decking membrane atop said roof decking substructure for protecting said roof decking substructure from environmental conditions;

positioning a second roof decking membrane atop said roof decking substructure for protecting said roof decking substructure from environmental conditions;

mating together first and second portions of said first and second roof decking membranes so as to form a seamed connection whereby said first and second roof decking membranes together provide continuous protection for said roof decking substructure against environmental conditions;

securing a hold-down structure, disposed upon a portion of said first roof decking membrane, to said roof decking substructure assembly so as to secure said first roof decking membrane to said roof decking substructure; and folding and securing a section of said first roof decking membrane with respect to itself such that when uplifting wind load forces act upon said first and second roof decking membranes, through means of said seamed connection, at least two sections of said first membrane will together operatively engage said hold-down structure and exhibit load-sharing reactive forces for resisting said uplifting wind load forces.

10. The method as set forth in claim 9, further comprising the step of:

selecting said hold-down structure from the group comprising membrane plates, membrane battens, membrane bars, and membrane strips.

11. The method as set forth in claim 9, wherein:

said folded section of said first roof decking membrane comprises an edge section which is folded over said hold-down structure and secured to said first roof decking membrane at a location immediately adjacent to said seamed connection, defined between said first and second portions of said first and second roof decking membranes, so as to define a closed loop which envelops said hold-down structure.

12. The method as set forth in claim 9, further comprising the step of:

securing said folded edge section of said first roof decking membrane to said first roof decking membrane at said location, and forming said seamed connection defined between said first and second portions of said first and second roof decking membranes, within and by means of a single welded region.

13. The method as set forth in claim 9, wherein:

said folded section of said first membrane comprises an edge section which is folded over said hold-down structure and secured by a first surface portion thereof to said first roof decking membrane so as to define a closed loop which envelops said hold-down structure; and said second portion of said second roof decking membrane is secured to a second surface portion of said edge section of said first roof decking membrane which defines said first portion of said first roof decking membrane defining said seamed connection.

14. The method as set forth in claim 13, further comprising the step of:

securing said folded edge section of said first roof decking membrane to said first roof decking membrane, and forming said seamed connection between said first and second portions of said first and second roof decking membranes, within and by means of a single welded region.

15. The method as set forth in claim 9, wherein:

said folded section of said first roof decking membrane comprises an edge section which is folded beneath said hold-down structure so as to have two plies of said first roof decking membrane secured beneath said hold-down structure at a location immediately adjacent to said seamed connection defined between said first and second portions of said first and second roof decking membranes.

16. The method as set forth in claim 9, wherein:

said folded section of said first roof decking membrane comprises an edge section which is folded over itself so as to be disposed atop said first roof decking membrane and beneath said hold-down structure so as to have two plies of said first roof decking membrane secured beneath said hold-down structure at a location immediately adjacent to said seamed connection defined between said first and second portions of said first and second roof decking membranes.

17. The system as set forth in claim 3, wherein:

said folded section of said first roof decking membrane, and said second portion of said second roof decking membrane, are both secured to said first roof decking membrane.

18. The system as set forth in claim 5, wherein:

said folded section of said first roof decking membrane is interposed between said first roof decking membrane and said second portion of said second roof decking membrane.

19. The method as set forth in claim 11, wherein:

said folded section of said first roof decking membrane, and said second portion of said second roof decking membrane, are both secured to said first roof decking membrane.

20. The method as set forth in claim 13, wherein:

said folded section of said first roof decking membrane is interposed between said first roof decking membrane and said second portion of said second roof decking membrane.

* * * * *